US007215921B2

(12) United States Patent
Matsumoto et al.

(10) Patent No.: US 7,215,921 B2
(45) Date of Patent: May 8, 2007

(54) IMAGE FORMING APPARATUS

(75) Inventors: Yuzo Matsumoto, Ibaraki (JP); Junichi Moteki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 10/998,903

(22) Filed: Nov. 30, 2004

(65) Prior Publication Data

US 2005/0129442 A1 Jun. 16, 2005

(30) Foreign Application Priority Data

Dec. 12, 2003 (JP) ..... 2003-415789
Sep. 16, 2004 (JP) ..... 2004-270329

(51) Int. Cl.
*G03G 15/00* (2006.01)
*G03G 15/14* (2006.01)

(52) U.S. Cl. ..... 399/405; 399/381; 399/390; 399/407

(58) Field of Classification Search ..... 399/405, 399/407, 390, 381
See application file for complete search history.

(56) References Cited

U.S. PATENT DOCUMENTS 5,535,012 A 7/1996 Matsumoto et al. ..... 358/400
5,580,045 A 12/1996 Matsumoto et al. ..... 271/298
6,021,305 A 2/2000 Sato et al. ..... 399/374
6,131,898 A 10/2000 Hiroi et al. ..... 271/10.03
6,203,003 B1 3/2001 Sato et al. ..... 271/3.01
6,219,503 B1 4/2001 Miyake et al. ..... 399/85
6,246,491 B1 6/2001 Matsumoto et al. ..... 358/468
6,398,214 B1 6/2002 Moteki et al. ..... 271/220
6,493,113 B1 12/2002 Fujii et al. ..... 358/488
6,801,750 B2 * 10/2004 Kawahira ..... 399/407
6,826,374 B2 11/2004 Kato et al. ..... 399/16
6,845,228 B2 1/2005 Suzuki et al. ..... 399/407
2004/0022564 A1 2/2004 Fujii et al. ..... 399/382
2004/0175213 A1 * 9/2004 Matsuzuki et al. ..... 399/384
2004/0252342 A1 * 12/2004 Kawahira ..... 358/1.18
2005/0063023 A1 3/2005 Komatsu et al. ..... 358/488
2005/0249511 A1 * 11/2005 Sekiguchi et al. ..... 399/20

FOREIGN PATENT DOCUMENTS

JP 2000-153947 6/2000

* cited by examiner

*Primary Examiner*—Daniel J. Colilla
*Assistant Examiner*—Marvin P. Crenshaw
(74) *Attorney, Agent, or Firm*—Fitzpatrick, Cella, Harper & Scinto

(57) ABSTRACT

An image forming apparatus, such as a printer, having a frame member, wherein there is provided, inside the frame member and on the upstream side of a sheet discharging portion with respect to the sheet conveying direction, a buffering device equipped with a rotary member capable of forward and reverse rotation, and wherein there are formed, along the peripheral surface of the rotary member, a buffering path for causing sheets to stay temporarily, a part of a sheet processing path for conveying sheets to a sheet processing apparatus, and a part of a re-conveying path for re-conveying sheets to an image forming portion.

7 Claims, 7 Drawing Sheets

IMAGE FORMING APPARATUS

BACKGROUND OF THE INVENTION

1. Field of the Invention

The present invention relates to an image forming apparatus having a buffering device on the upstream side of a sheet processing apparatus and on the downstream side of an image forming portion, and more particularly, to an image forming apparatus whose frame member has a buffering device and a sheet processing apparatus arranged therein.

2. Related Background Art

Recently, in image forming apparatuses, such as copying machines, printers, facsimile machines, and composite apparatuses composed thereof, there has been an improvement in performance in terms of image quality, number of prints per unit time, etc.; in particular, there has been a marked improvement in printing speed at the time of image formation. In view of this, the interval between the sheets on which image formation is to be performed is set as small as possible.

Conventionally, there exists an image forming apparatus, such as a copying machine, a printer, a facsimile machine, or a composite apparatus composed thereof in which a sheet on which an image has been formed on the obverse side (first side) thereof is conveyed again to the image forming portion to form an image thereon. In such an image forming apparatus, there is provided a re-conveying path for conveying a sheet with an image formed on the obverse side (first side) thereof to the image forming portion again to perform image formation on the reverse side (second side) thereof.

In such an image forming apparatus, a sheet accommodated in a sheet feeding cassette is fed by a sheet feeding apparatus, and then the sheet is sequentially conveyed to an image forming portion, a fixing portion, and a discharging portion. At that time, if image formation is to be performed on both sides of the sheet or in superimposition on one side thereof, the sheet is conveyed to a re-conveying path to convey it to the image forming portion again.

Further, as a conventional image forming system, there is available one having a sheet processing apparatus on the discharge side of the image forming apparatus main body for performing a processing such as binding sheets with images formed thereon; in the case of such an image forming system, in order to improve productivity of the image forming apparatus, there is provided, for example, in a sheet processing path through which sheets are conveyed to the sheet processing portion of the sheet processing apparatus, a buffering device, which is a buffering portion for causing sheets with images formed thereon to stay temporarily while the sheet processing portion is performing sheet processing.

By providing such a buffering device in the sheet processing apparatus, while the sheet processing portion is performing the processing operation, a plurality of sheets with images formed thereon are caused to stay temporarily by winding the sheets around a buffer roller provided in the buffering device, thus securing the requisite sheet processing time. In this buffering device, when the processing operation is completed, the plurality of wound sheets are discharged at a time toward the sheet processing portion (see JP 2000-153947 A).

Incidentally, in recent image forming apparatuses, the printing speed (the image forming speed) up to the discharge is set high, whereas the discharging speed when discharging and stacking sheets with images formed thereon is set relatively low in order to secure the requisite stacking alignment. For, if the sheets are discharged while maintaining the high printing speed, there is a possibility of the sheets going so far as to interfere with the stacking alignment. Thus, as in the case of securing the sheet processing time, in order to adjust the difference between the printing speed and the discharging speed, it is necessary to cause the sheets with images formed thereon to stay temporarily.

Further, in the conventional sheet processing apparatus, as the buffer roller of the buffering device, there is used a large roller having a circumferential length longer than the sheet length so that a plurality of sheets can be properly wound around it. However, when such a large roller is used, the size of the buffering device increases, with the result that the size of the sheet processing apparatus increases.

Further, in the sheet processing apparatus, there exist a plurality of sheet conveying paths, such as the sheet processing path, the buffering path provided in the buffering device and formed along the peripheral surface of the buffer roller, the discharging path for conveying sheets with images formed thereon to the discharging portion, and the re-conveying path. When a plurality of sheet conveying path exist in the apparatus main body, not only a rather complicated construction but also an increase in the size of the sheet processing apparatus is involved.

SUMMARY OF THE INVENTION

The present invention has been made in view of the above problems in the conventional art. It is accordingly an object of the present invention to provide an image forming apparatus effective in achieving high productivity. Another object of the present invention is to provide an image forming system which is easily installed in a small space even when a sheet processing apparatus is provided in the image forming apparatus.

The present invention provides an image forming apparatus including an image forming portion which forms an image on a sheet, a sheet discharging portion which discharges the sheet with the image formed thereon by the image forming portion, and a buffering device which causes the sheet with the image formed thereon to stay temporarily, wherein the buffering device is provided inside the apparatus main body at a position on the upstream side of the sheet discharging portion with respect to the sheet conveying direction.

Thus, in the present invention, a buffering device which causes a sheet with an image formed thereon to stay temporarily is provided inside the frame member of the apparatus main body at a position on the upstream side of the sheet discharging portion with respect to the sheet conveying direction, whereby there is no need to set the image forming speed low so as to adapt it to the sheet discharging speed. Accordingly, it is possible to achieve high productivity. Further, by arranging the buffering device inside the frame member of the apparatus main body, it is possible to achieve miniaturization of the sheet processing apparatus and simplification of the construction thereof, so that, when attaching the sheet processing apparatus to the image forming apparatus, it can be easily attached in a small mounting space, for example, a discharging space provided between the image reading apparatus and the image forming apparatus.

DESCRIPTION OF THE PREFERRED EMBODIMENTS

In the following, the best mode for carrying out the present invention will be described in detail with reference to the drawings.

Figure 1:
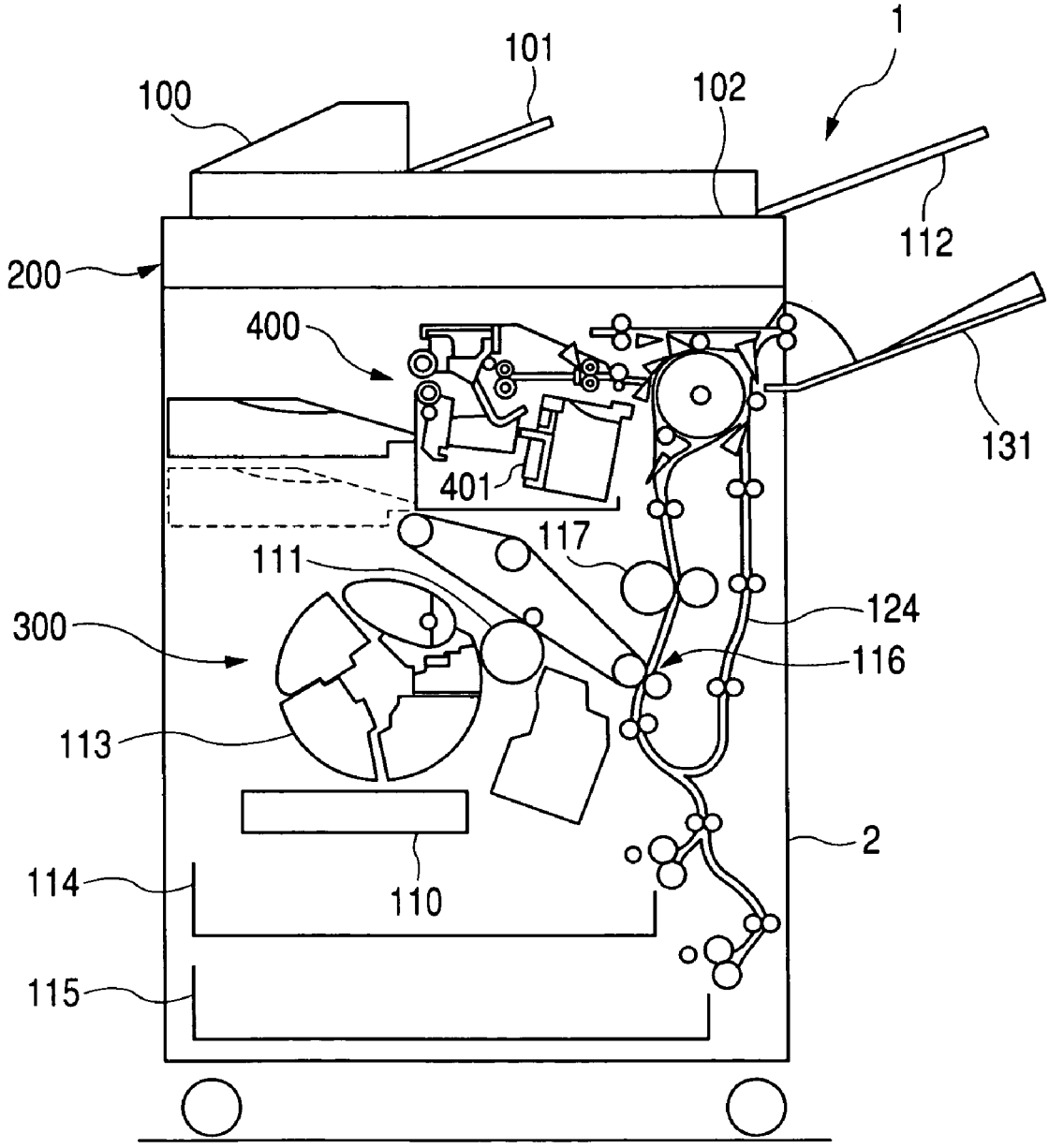
FIG. 1 is a schematic diagram showing the construction of a printer constituting an example of an image forming apparatus according to an embodiment of the present invention.

FIG. 1 is a schematic diagram showing the construction of a printer constituting an example of an image forming apparatus according to an embodiment of the present invention.

In FIG. 1, a printer 1 constituting the image forming apparatus comprises a printer main body 2. On top of the printer main body 2, there is provided an image reader 200 serving as an image reading apparatus, and, inside the printer main body 2, there is provided an image forming portion 300.

Here, this image reader 200 comprises an original feeding device 100 for feeding originals onto an original plate 102, and a scanner unit (not shown) for reading the images of the originals fed to the original plate 102.

When reading the original images, the original feeding device 100 feeds one by one the originals (not shown) set face up on an original table 101, starting with the uppermost original, to the original plate 102, and, after the images have been read, the originals are discharged onto the a discharge tray 112. When an original is fed onto the original plate, the scanner unit illuminates the original, and reflection light from the original is guided to an image sensor by way of a mirror and a lens, whereby the image of the original is read. While in this embodiment the image reader 200 is arranged on top of the printer main body 2, the image reader 200 is not an indispensable component, and the present invention proves effective if applied to an image reading apparatus solely consisting of the printer main body 2.

The image forming portion 300 comprises a photosensitive drum 111, an exposure control portion 110 which outputs to the photosensitive drum 111 a laser beam corresponding to an image signal that has undergone image processing after the reading by the image sensor to form an electrostatic latent image on the photosensitive drum, a developing device 113 for developing the electrostatic latent image on the photosensitive drum, a transfer portion 116 for transferring to a sheet a toner image developed by the developing device 113, a fixing portion 117 for performing a toner image fixing processing on the sheet to which the toner image has been transferred, etc.

In cassettes 114 and 115 arranged in the lower portion of the printer main body 2, there are accommodated sheets on which image formation is to be performed. A finisher 400, which is a sheet processing apparatus for performing a processing on sheets that have undergone image formation, has, in a processing portion for temporarily stacking the sheets that have undergone image formation to perform a processing thereon, a stapler 401, for instance, which is a processing means for performing a binding processing.

In this embodiment, the printer 1 is capable of performing image formation on both sides of a sheet. When performing image formation on both sides of a sheet, the sheet with an image formed on its obverse surface (the first surface) is reversed, and is then passed through a duplex transport path 124 to convey it to the image forming portion 300 again.

In the image forming portion 300, constructed as described above, when, after an original image has been read by the image sensor, an image signal that has undergone image processing is input to the exposure control portion 110, the exposure control portion 110 applies a laser beam corresponding to the image signal to the photosensitive drum 111, whereby an electrostatic latent image is formed on the photosensitive drum.

Next, the electrostatic latent image on the photosensitive drum is developed by the developing device 113 to form a toner image on the photosensitive drum; thereafter, when a sheet fed from either the cassettes 114 and 115 or the duplex transport path 124 passes a transfer portion 116, the toner image is transferred to the sheet. Then, in a fixing portion 117, a toner image fixing processing is performed on the sheet on which the toner image has been thus transferred.

Figure 2:
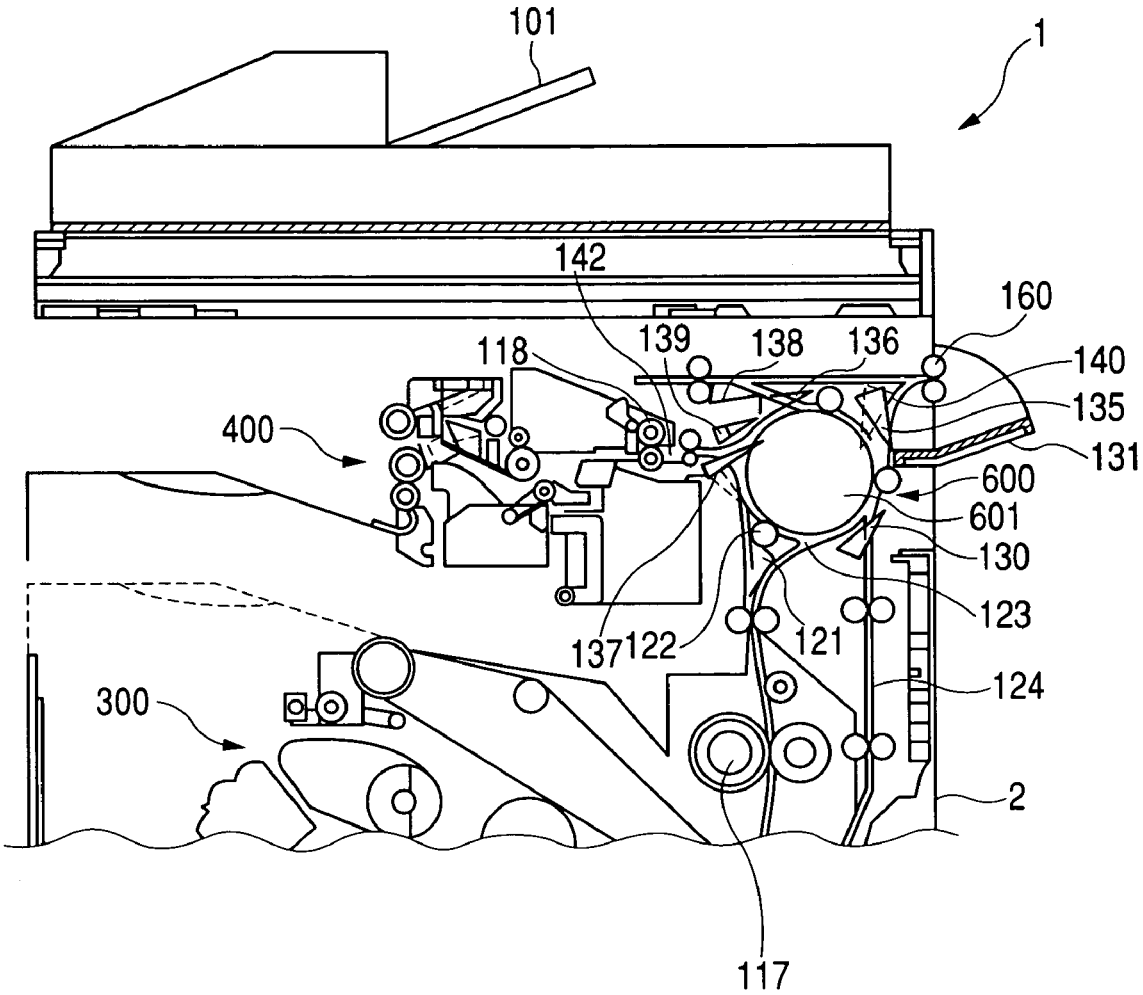
FIG. 2 is a diagram illustrating the construction of a buffering device provided in the printer.

When a plurality of sheets are to be output (when there are successive pages), the sheets having passed the fixing portion 117 are guided by a first flapper 121 shown in FIG. 2 to a first discharging path 122 for conveying sheets to the finisher 400, and are discharged by discharging rollers 118 to the finisher 400, with the surfaces with images directed downwards (face down). By thus discharging the sheets face down, the proper page order is maintained when the original feeding apparatus 100 is used or images output from a computer are printed successively starting with the foremost page. When there is no need for a buffering operation described below, for example, when the sheets are to be discharged without undergoing a sheet processing in the finisher 400, or when no sheets are temporarily stacked in the processing portion of the finisher 400, the first discharging path 122 is selected by the first flapper 121.

While in this embodiment the finisher 400 is connected and arranged on the downstream side of the discharging roller 118 with respect to the sheet conveying direction, when no finisher 400 is attached, the sheets discharged by the discharging rollers 118 are stacked in a discharging space serving as the mounting space for the finisher 400. In order that the discharged sheets may not go too far to disturb the stacking alignment, the discharging speed by the discharging rollers 118 is kept lower than the process speed (the printing speed) at which the sheets are conveyed for image formation until they pass the fixing portion 117. In this embodiment the speed at which the sheets are conveyed inside the finisher 400 when the finisher 400 is mounted is set to be the same as the speed at which the sheets are conveyed by the discharging rollers 118. However, when the sheet conveying path in the finisher 400 is long, it is possible to increase the sheet conveying speed after the passing of the discharging roller 118 in order to shorten the sheet processing time.

In this way, each sheet discharged into the discharging space or sent into the finisher 400 undergoes a temporary reduction in speed at the discharging rollers 118, so that the interval between this sheet and the subsequent sheet being conveyed at the process speed, which is higher than the discharging speed, is reduced. In order to prevent collision of the preceding sheet and the subsequent sheet, it is necessary to adjust the setting of the difference between the discharging speed and the process speed. When a higher priority is given to stacking alignment, the difference is set smaller, approximating the process speed to the discharging speed.

When the number of sheets (pages) to be output is only one (i.e., when there are no successive pages), the sheet is guided to a second discharging path 140 by way of a buffer path 123, with its surface with a toner image transferred thereto facing upward (i.e., face up), through switching of the flappers 121, 130, and 135, and is discharged onto a sample tray 131. That is, in this embodiment, the buffer path 123 constitutes a part of the discharging path for discharging sheets. Further, as described below, this buffer path 123 constitutes a part of a re-conveying path.

Incidentally, in this embodiment, there is provided, between the image forming portion 300 and the finisher 400, a buffering device 600, which is a buffering portion that causes a plurality of sheets to stay temporarily in order to secure the requisite time for the binding operation so that the conveyance of sheets can be continued even when the finisher 400 is performing the binding operation, and then conveys the sheets toward the finisher 400. Further, in this embodiment, the buffering device 600 is provided in the frame member of the printer main body 2. By providing the buffering device 600 inside the frame member of the printer main body 2, it is also possible to eliminate the problem due to the difference between the discharging speed and the process speed. That is, after causing a plurality of sheets to stay temporarily in the buffering device 600, the sheets are discharged by the discharging rollers 118, whereby there is no need to approximate the process speed to the discharging speed to reduce the difference therebetween.

Here, this buffering device 600 comprises the buffer path 123 for causing a plurality of sheets to stay temporarily, a buffer roller 601 consisting of a rotary member constituting the guide surface of the buffer path 123 and capable of forward and reverse rotation, the first flapper 121 for guiding a sheet having passed the fixing portion 117 selectively to the buffer path 123 or to the first discharging path 122, the second and third flappers 130 and 135 which, as described above, guide a sheet having entered the buffer path 123 to the sample tray 131 by way of a second discharging path 140, fourth through sixth flappers 136, 139, and 137 for causing a sheet having entered the buffer path 123 to enter a third discharging path 142 leading to the finisher 400, and a seventh flapper 138 for discharging a sheet to the sample tray 131, with its surface with an image formed thereon facing downwards (i.e., face down). While in this embodiment the buffering device 600 is formed by a rotary member and a buffering path formed on the peripheral surface thereof, it is also possible for the buffering device to be one adapted to retain sheets in a linear fashion. Thus, there are no limitations regarding the configuration of the buffering device as long as it is capable of causing a plurality of sheets to stay temporarily.

In this embodiment, as described below, the first through seventh flappers 121, 130, 135, 136, 139, 137, and 138, which are changing means for changing the sheet conveying direction according to the rotating direction of the buffer roller 601, are provided on the printer main body side.

Next, the operation of the buffering device 600, constructed as described above, will be described.

First, a case will be described in which a plurality of sheets are caused to stay and then conveyed to the finisher 400.

Figure 3A:
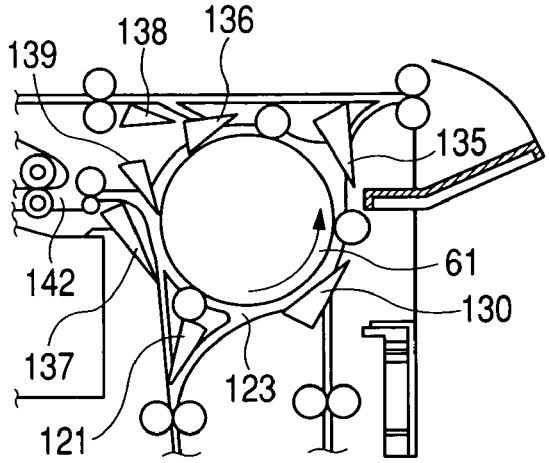
FIGS. 3A, 3B, and 3C are first diagrams illustrating the operation of the buffering device.

In this case, the sheets having passed the fixing portion 117 are guided to the buffer path 123 by the first flapper 121, which is switched to the position as shown in FIG. 3A, and are controlled so as to be wound around the buffer roller 601. In this process, the second through sixth flappers 130, 135, 136, 139, and 137 are controlled so as to be separated from the buffer roller 601. At this time, the buffer roller 601 makes reverse rotation, that is, rotates counterclockwise, whereby several sheets are wound around the buffer roller 601.

Next, after several sheets have been wound around the buffer roller 601, the sixth flapper 137 is controlled so as to abut the buffer roller 601, whereby the several sheets wound around the buffer roller 601 are guided to the third discharging path 142 to be guided to the finisher 400.

Also when no finisher 400 is mounted, sheets are guided to the discharging space, constituting the mounting space for the finisher 400, by the same route.

Next, a case will be described in which image formation is performed on both side of a sheet.

Figure 3B:
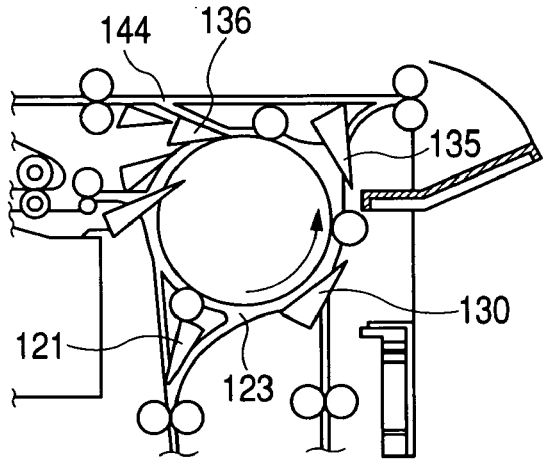

In this case, the sheet first having passed the fixing portion 117 as shown in FIG. 3B, is guided to the buffer path 123 by the first flapper 121. At this time, the second and third flappers 130 and 135 are controlled so as to be separated from the buffer roller 601, and the fourth flapper 136 is controlled so as to abut the buffer roller 601. When, in this state, the buffer roller 601 rotates counterclockwise, the sheet is guided to a sheet surface reverse path 144 constituting the reversing portion.

Figure 3C:
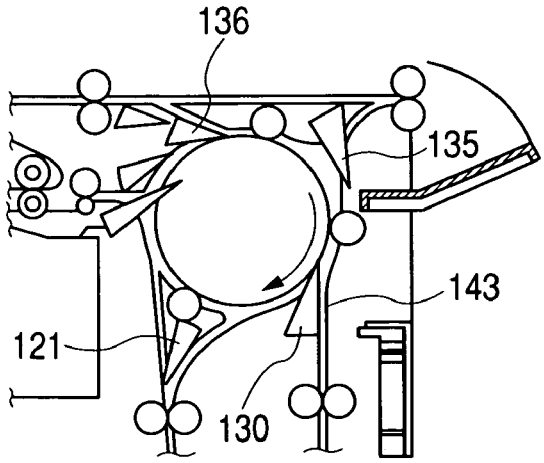

Thereafter, when the trailing edge of the sheet leaves the second flapper 130, the second flapper 130 is controlled so as to abut the buffer roller 601 as shown in FIG. 3C. At the same time, the buffer roller 601 is controlled so as to make forward rotation, that is, to rotate clockwise. As a result, the sheet is guided to the re-conveying paths 143 and 124 by way of the buffer path 123, and is guided to the transfer portion 116 and the fixing portion 117 for image formation on the other side.

Incidentally, by thus rotating the buffer roller 601 to rotate clockwise, it is possible to perform reversal and discharging of a sheet simultaneously. In the following, this will be illustrated.

Figure 4A:
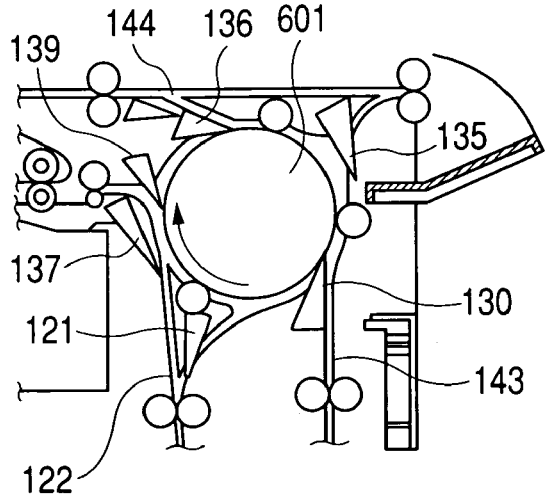
FIGS. 4A, 4B, and 4C are second diagrams illustrating the operation of the buffering device.

In this case, the sheet having passed the fixing portion 117 first is guided to the buffer path 123 by the first flapper 121, and the buffer roller 601 is rotated counterclockwise to cause the fourth flapper 136 to abut the buffer roller 601, controlling the sheet so as to be guided to the reversing path 144. Next, when the trailing edge of the sheet leaves the second flapper 130, the second flapper 130 is controlled so as to abut the buffer roller 601 as shown in FIG. 4A. At the same time, the first flapper 121 is controlled so as to guide the sheet to the first discharging path 122. At this time, the fifth and sixth flappers 139 and 137 move to the positions as shown in FIG. 4A.

At the same time, the buffer roller 601 rotates clockwise to thereby reverse the sheet existing in the reversing path 144, guiding it to the re-conveying path 143. At the same time, the sheet with images formed on both sides thereof is guided to the first discharging path 122, and is discharged to the finisher 400 side.

Next, a case will be described in which a sheet having passed the fixing portion 117 is discharged onto the sample tray 131.

Figure 4B:
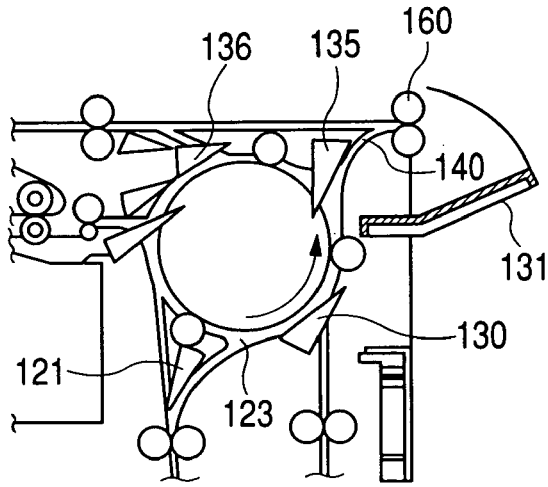

As shown in FIG. 4B, in this case, the sheet is guided to the buffer path 123 by the first flapper 121, and the third flapper 135 is controlled so as to abut the buffer roller 601. By rotating the buffer roller 601 counterclockwise, the sheet is guided to the second discharging path 140, and is discharged onto the sample tray 131 by the discharging roller 160.

In this case, the sheet is discharged, with its surface to which a toner image has been transferred facing upwards (face up). In the case of a sheet on which image formation has been effected on both sides thereof, it is discharged, with the second surface facing upwards. However, by previously changing the order in which the images are to be written to the sheet by the printer 300, it is also possible for the sheet to be discharged, with the first surface facing upwards.

Figure 4C:
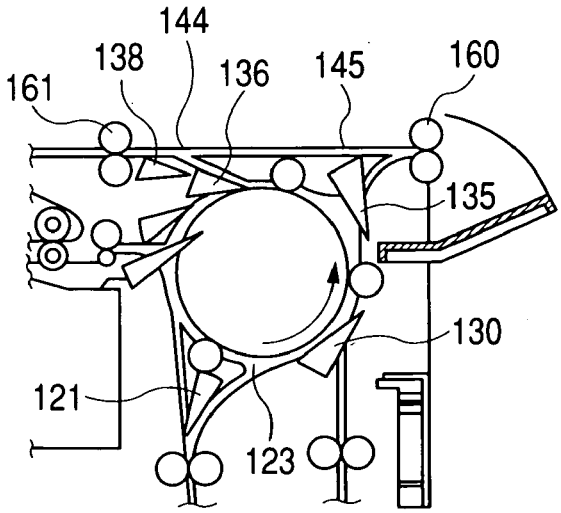
Figure 5:
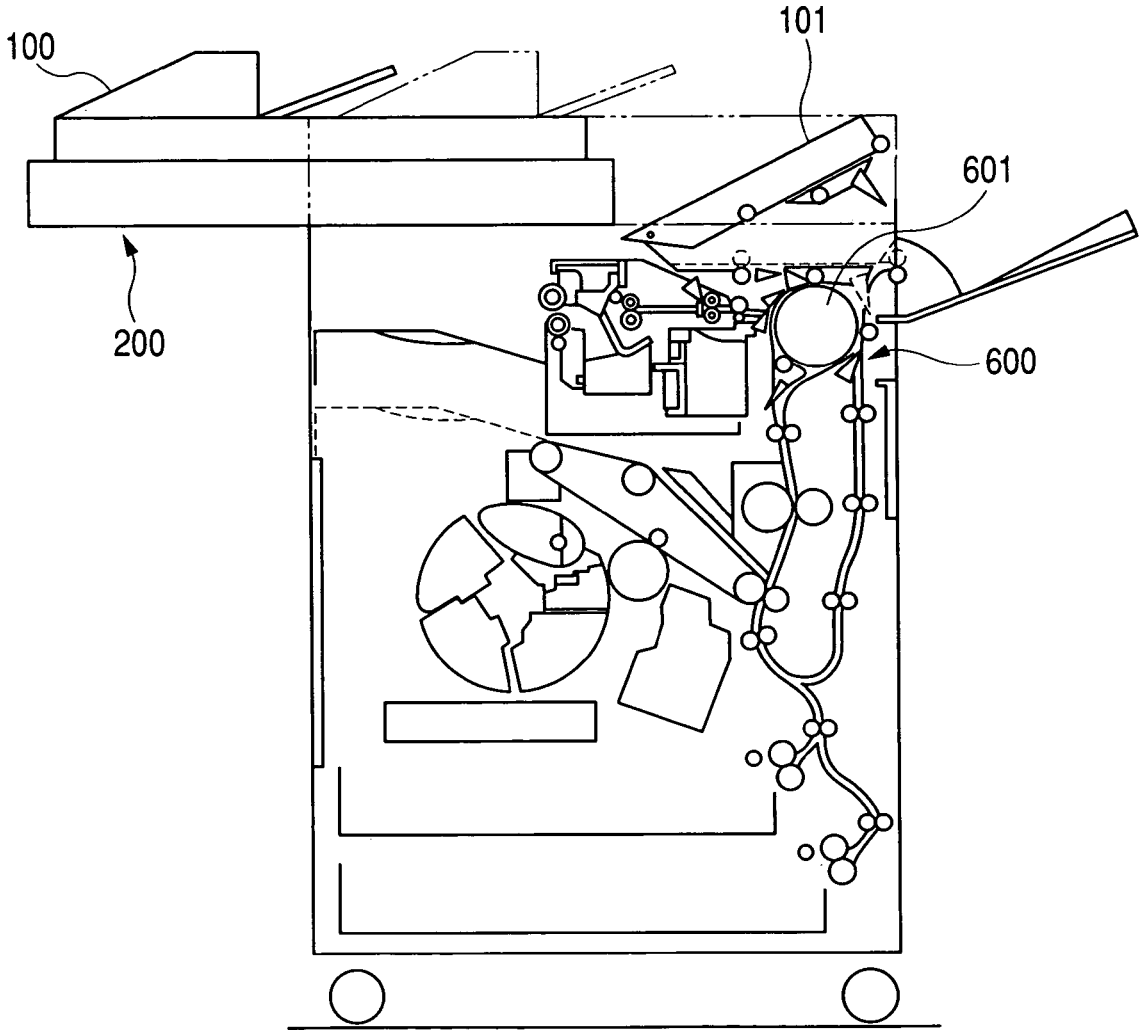
FIG. 5 is a first diagram showing a construction for jam processing in the buffering device in the above printer.

Further, as shown in FIG. 4C, when the buffer roller 601 is rotated counterclockwise, guiding the sheet to the buffer path 123 by the first and second flappers 121 and 130, and guiding the sheet to the reversing path 144 by the third, fourth, and seventh flappers 135, 136, and 138, and when the trailing edge of the sheet leaves the seventh flapper 138, the seventh flapper 138 is controlled so as to face upwards.

Thereafter, by reversing a conveying roller 161 provided in the reversing path 144, the sheet is guided to a path 145, and is discharged onto the sample tray 131 by a discharging roller 160, with its surface with an image formed thereon facing downwards (face down).

Incidentally, in this embodiment, the original feeding apparatus 100 and the image reader 200 are mounted to the printer main body 2 so as to be horizontally slidable. Due to this construction, when jamming occurs in the buffering device, by horizontally sliding the original feeding apparatus 100 and the image reader 200, it is possible to open a door 101 arranged above the buffering device 600, making it possible to remove the jammed sheet.

Figure 6:
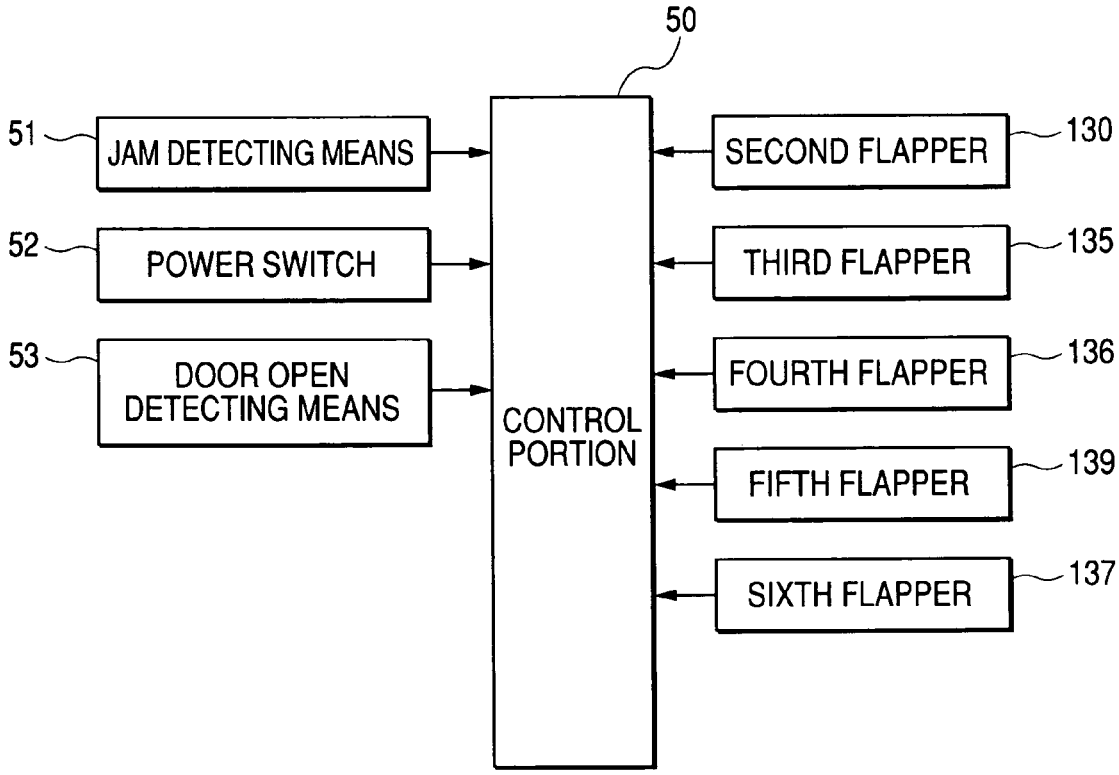
FIG. 6 is a control block diagram of the buffering device.

Further, in this embodiment, each of the second through sixth flappers 130, 135, 136, 139, and 137 provided in the printer main body 2 can be selectively moved, by means of a solenoid (not shown) drive-controlled by a control portion 50 serving as a control means as shown in FIG. 6, to a first position where it abuts the buffer roller 601 so as to abut the sheet conveyed through the buffer path 123 and to a second position where it is spaced apart from the buffer roller 601 so as not to abut the sheet conveyed through the buffer path 123.

The control portion 50 switches the second through sixth flappers 130, 135, 136, 139, and 137 to the second positions based on at least one of the following detection signals: a detection signal from a detecting means 51 for detecting sheet jamming in the buffer path, and a detection signal from a door open detecting means 53 for detecting turning off of a power switch 52 for turning the power on and opening of the door 101 to remove the jammed sheet.

When thus removing the jammed sheet, by switching the second through sixth flappers 130, 135, 136, 139, and 137 to the second positions, the jamming can be easily dealt with.

Figure 7:
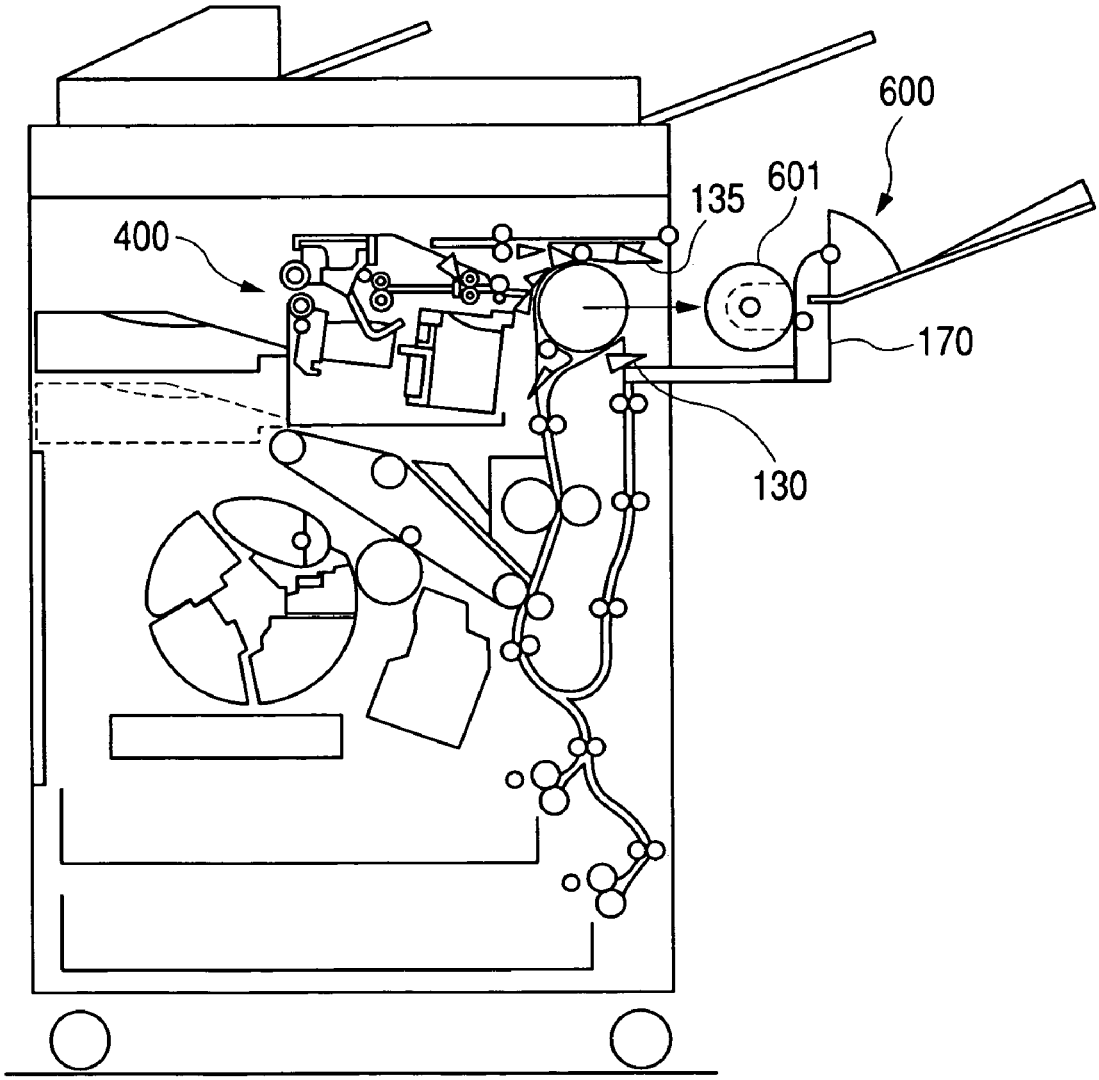
FIG. 7 is a second diagram showing the construction for jam processing in the buffering device in the above printer.

Further, in this embodiment, the buffering device 600 is detachably mounted to the printer main body 2, and, when jamming occurs in the buffering device 600, a cover 170 on a side surface of the printer main body 2 is caused to slide horizontally as shown in FIG. 7, whereby the buffering device 600 can be drawn out integrally with the cover 170.

When thus drawing out the buffering device 600, the control portion 50 switches at least the second and third flappers 130 and 135, situated on the downstream side with respect to the drawing-out direction, to the second positions, as shown in FIG. 7, based on at least one of the following detection signals: a detection signal from the jamming detecting means 51 and a detection signal from a drawing-out operation detecting means, such as a micro switch (not shown), for detecting turning off of the power switch 52 and drawing-out operation of the buffering device 600.

By thus switching at least the second and third flappers 130 and 135, situated on the downstream side with respect to the drawing-out direction, to the second positions when drawing out the buffering device 600, the buffering device 600 can be drawn out easily, and the jammed sheet can be removed easily.

Incidentally, by switching the positions of the first through seventh flappers 121, 130, 135, 136, 139, 137, and 138, this control portion 50 switches the sheet conveying direction and controls the forward/reverse rotation of the buffer roller 601.

Through this control of the control portion 50, the sheet conveying direction is changed as follows: when the buffer roller 601 rotates counterclockwise, it is selectively changed such that the sheet is headed for the reversing path, the sample tray, which is on the downstream side of the second discharging path 140, or the finisher; and when the buffer roller 601 rotates clockwise, it is selectively changed such that the sheet is headed for the finisher by way of the re-conveying paths 143 and 124, the finisher, or the image forming portion.

Further, by controlling the rotating direction of the buffer roller 601 and the sheet conveying direction changing operation of each flapper, this control portion 50 causes, as stated above, the buffer roller 601 to rotate clockwise, for example, whereby it is possible to simultaneously effect re-conveyance of the sheet to the image forming portion 1 and the conveyance thereof to the finisher 400.

As stated above, the buffer path 123 is formed so as to extend along the peripheral surface of the buffer roller 601, and, after the clockwise rotation of the buffer roller 601 and image formation, the sheet conveyed to the first discharging path 122 is conveyed to the finisher 400, and the sheet in the re-conveying path is conveyed in the direction of the image forming portion 1, whereby, even in a case in which the buffering device 600 and a plurality of sheet conveying paths including the buffer path 123 are provided in the frame member of the printer main body 2, it is possible to achieve a reduction in the size of the printer 1 and a simplification in the construction thereof.

Further, by thus making it possible to simultaneously perform the conveyance and reversal of the sheet, it is possible to improve the printer 1 in terms of productivity. Further, when, as in this embodiment, a plurality of sheet conveying paths are provided, it is possible to freely select the sheet outputting method and the sheet outputting position, whereby a user has a wider choice of options.

While in this embodiment the buffering device 600 is arranged inside the printer main body frame, that is, above the image forming portion and in an extension of the longitudinal path passing the transfer portion 116 and the fixing portion 117, in the present invention this should not be construed restrictively; it may also be arranged in the finisher 400 and on the upstream side of the stapler 401 (see FIG. 1).

This application claims priority from Japanese Patent Application No. 2003-415789 filed on Dec. 12, 2003, which is hereby incorporated by reference herein.

What is claimed is:

1. An image forming apparatus comprising:

an image forming portion which forms an image on a sheet;

a sheet discharging portion which discharges the sheet with the image formed thereon by the image forming portion; and a buffering device which causes the sheet with the image formed thereon to stay temporarily, wherein the buffering device is provided inside a main body of the image forming apparatus and on an upstream side of the sheet discharging portion with respect to a sheet conveying direction, wherein the buffering device comprises a rotary member capable of forward and reverse rotation and having on a peripheral surface thereof a buffering path for causing the sheet with the image formed thereon to stay temporarily through reverse rotation of the rotary member, and wherein the sheet with the image formed thereon is conveyed to the sheet discharging portion through reverse rotation of the rotary member.

2. An image forming apparatus comprising:

an image forming portion which forms an image on a sheet;

a first sheet discharging portion which discharges the sheet with the image formed thereon by the image forming portion;

a buffering device which causes the sheet with the image formed thereon to stay temporarily; and a second sheet discharging portion which discharges a sheet, with its surface with an image formed thereon facing in a direction opposite to that of the sheet as discharged from the first sheet discharging portion, wherein the buffering device is provided inside a main body of the image forming apparatus and on an upstream side of the first sheet discharging portion with respect to a sheet conveying direction, wherein the buffering device comprises a rotary member capable of forward and reverse rotation and having on a peripheral surface thereof a buffering path for causing the sheet with the image formed thereon to stay temporarily through reverse rotation of the rotary member, and wherein the sheet with the image formed thereon is conveyed to the second sheet discharging portion through reverse rotation of the rotary member.

3. An image forming apparatus comprising:

an image forming portion which forms an image on a sheet;

a sheet discharging portion which discharges the sheet with the image formed thereon by the image forming portion;

a buffering device which causes the sheet with the image formed thereon to stay temporarily;

a re-conveying path which conveys the sheet with the image formed thereon to the image forming portion again; and a reversing portion provided on an upstream side of the re-conveying path with respect to the sheet conveying direction and adapted to reverse the sheet, wherein the buffering device is provided inside a main body of the image forming apparatus and on an upstream side of the sheet discharging portion with respect to a sheet conveying direction, wherein the buffering device comprises a rotary member capable of forward and reverse rotation and having on a peripheral surface thereof a buffering path for causing the sheet with the image formed thereon to stay temporarily through reverse rotation of the rotary member, and wherein the sheet is conveyed to the reversing portion through reverse rotation of the rotary member to be reversed, and then the reversed sheet is conveyed to the re-conveying path through forward rotation of the rotary member.

4. An image forming apparatus according to claim 3, further comprising a flapper provided in the buffering path, which changes the conveying direction of the sheet with the image formed thereon, wherein the flapper selectively changes the conveying direction of the sheet such that, when the rotary member makes reverse rotation, the sheet is headed for the reversing portion side of the re-conveying path or the downstream side of the discharging path, or is conveyed along the rotary member, and that, when the rotary member makes forward rotation, the sheet is headed for the sheet processing apparatus, or the image forming portion side of the re-conveying path.

5. An image forming apparatus according to claim 4, further comprising a control portion which controls a rotating direction of the rotary member and a sheet conveying direction changing operation of the flapper, wherein the control portion controls the rotating direction of the rotary member and the sheet conveying direction changing operation of the flapper such that re-conveyance of the sheet to the image forming portion and conveyance thereof to the sheet processing apparatus are effected simultaneously.

6. An image forming apparatus comprising:

an image forming portion which forms an image on a sheet;

a sheet discharging portion which discharges the sheet with the image formed thereon by the image forming portion; and a buffering device which causes the sheet with the image formed thereon to stay temporarily, wherein the buffering device is provided inside a main body of the image forming apparatus and on an upstream side of the sheet discharging portion with respect to a sheet conveying direction, wherein a sheet processing apparatus for performing a processing on a sheet discharged from the sheet discharging portion is provided on a downstream side of the sheet discharging portion, wherein a sheet discharging space for discharging sheets by the sheet discharging portion is provided in an upper portion of the image forming apparatus main body, and wherein the sheet processing apparatus is provided in the sheet discharging space.

7. An image forming apparatus according to claim 6, wherein an image reading apparatus for reading an original image is provided above the sheet discharging space.

* * * * *

UNITED STATES PATENT AND TRADEMARK OFFICE

CERTIFICATE OF CORRECTION

PATENT NO. : 7,215,921 B2
APPLICATION NO. : 10/998903
DATED : May 8, 2007
INVENTOR(S) : Yuzo Matsumoto et al.

It is certified that error appears in the above-identified patent and that said Letters Patent is hereby corrected as shown below:

COLUMN 2:
Line 16, “exist” should read --exists--.
Line 22, “path” should read --paths--.
Line 23, “exist” should read --exists--.

Signed and Sealed this

Twenty-fifth Day of December, 2007

JON W. DUDAS
*Director of the United States Patent and Trademark Office*